United States Patent [19]

Watanabe et al.

[11] Patent Number: 4,622,565

[45] Date of Patent: Nov. 11, 1986

[54] MULTI-COLORED IMAGE RECORDING METHOD AND THERMOSENSITIVE IMAGE TRANSFER SHEET FOR USE IN THE RECORDING METHOD

[75] Inventors: Hideo Watanabe; Kanjiro Kawasaki, both of Numazu; Keishi Kubo, Yokohama; Minoru Hakiri; Nobuhiro Takigawa, both of Numazu, all of Japan

[73] Assignee: Ricoh Company, Ltd., Tokyo, Japan

[21] Appl. No.: 696,513

[22] Filed: Jan. 30, 1985

[30] Foreign Application Priority Data

Feb. 1, 1984 [JP] Japan ..... 59-18103

[51] Int. Cl.[4] ..... B41M 5/18

[52] U.S. Cl. ..... 346/201; 346/204; 346/206; 346/208; 346/220; 346/221; 346/226; 427/151; 427/152

[58] Field of Search ..... 346/204, 200, 226, 206, 346/201, 208, 220, 221; 427/150, 151, 152

[56] References Cited

FOREIGN PATENT DOCUMENTS 0075893 6/1981 Japan ..... 346/206

*Primary Examiner*—Bruce H. Hess

*Attorney, Agent, or Firm*—Oblon, Fisher, Spivak, McClelland & Maier

[57] ABSTRACT

A multi-colored image recording method capable of producing in repetition clear multi- and full-colored images having high density on a number of receiving sheets is disclosed, in which a thermosensitive image transfer sheet including four leuco dye layers respectively containing yellow, magenta, cyan and black leuco dyes that can be respectively colored in yellow, magenta, cyan and black, and a color developer layer containing a color developer capable of developing the leuco dyes in the four colors is superimposed on a receiving sheet and heat is applied to the thermosensitive image transfer sheet in accordance with the desired color tone information, whereby the leuco dyes and the color developer are transferred from the image transfer sheet onto the receiving sheet so as to selectively overlap the leuco dyes and the color developer, thereby producing multi-colored images by the coloring reaction therebetween.

16 Claims, 4 Drawing Figures

MULTI-COLORED IMAGE RECORDING METHOD AND THERMOSENSITIVE IMAGE TRANSFER SHEET FOR USE IN THE RECORDING METHOD

BACKGROUND OF THE INVENTION

1. Field of the Invention

The present invention relates to a multi-colored image recording method utilizing a coloring reaction between a leuco dye and a color developer, capable of producing multi-colored images on a receiving sheet, and to a thermosensitive image transfer sheet for use in this recording method which can be used in repetition.

2. Discussion of the Background

Conventionally, a method of recording multi-colored images by utilizing a coloring reaction between a leuco dye and a color developer is known. In the conventional method, a plurality of thermosensitive coloring layers are overlaid on a support sheet and a different color is developed in each thermosensitive coloring layer. Therefore, the number of the colors that can be developed is limited or 2 to 3 colors at most.

In Japanese Laid-Open Patent Application Ser. No. 57-69094, a method of producing full-color images is disclosed, in which method, there is employed a thermosensitive image transfer material comprising a support material coated in mosaic with a plurality of thermosensitive inks which are different in the melting point and in the color tone. The thermal transfer of such inks to a sheet of paper is carried out with the temperature of the applied heat changed, whereby it is intended to produce full-color images. This method, however, has the shortcomings that it is difficult to obtain clear full-color images and the same image transfer material cannot be used in repetition to produce the images.

SUMMARY OF THE INVENTION

It is therefore an object of the present invention to provide a multi-colored image recording method capable of producing in repetition clear multi- and full-colored images having high density on a number of sheets.

In the multi-colored image recording method according to the present invention, a thermosensitive image transfer sheet including four leuco dye layers containing leuco dyes that can be colored in yellow, magenta, cyan and black, and a color developer layer containing a color developer capable of developing the respective leuco dyes in the respective colors is superimposed on a receiving sheet. Heat is applied to the thermosensitive image transfer sheet in accordance with the desired color tone information, whereby the leuco dyes and the color developer are transferred from the image transfer sheet onto the receiving sheet so as to selectively overlap the leuco dyes and the color developer, thereby producing multi-colored images by the coloring reaction therebetween.

BRIEF DESCRIPTION OF THE DRAWINGS

In the drawings,

FIG. 2 is a schematic illustration of another thermosensitive image transfer sheet for use in the present invention, in which leuco dye layers a through d and color developer layers e are arranged side by side in the moving direction indicated by the arrow, having a repetition unit of each color developer layer e being interposed between each leuco dye layer d and each leuco dye layer a.

DETAILED DESCRIPTION OF THE PREFERRED EMBODIMENTS

In the present invention, the leuco dye layers containing leuco dyes that can be colored in yellow, magenta, cyan and black and the color developer layer containing a color developer capable of developing the leuco dyes in the four colors are supported by the same support sheet. On the support sheet, the four leuco dye layers and the color developer layer constitute a repetition unit.

By referring to the accompanying drawing, the present invention will now be explained in detail.

FIGS. 1 through 4 schematically show thermosensitive image transfer sheets for use in the present invention, in which reference symbol a indicates a leuco dye layer containing a leuco dye that can be colored in yellow; reference symbol b, a leuco dye layer containing a leuco dye that can be colored in magenta; reference symbol c, a leuco dye layer that can be colored in cyan; reference symbol d, a leuco dye layer that can be colored in black; and reference symbol e, a color developer layer containing a color developer capable of inducing color formation in the above leuco dyes in contact therewith under application of heat thereto.

Figure 1:
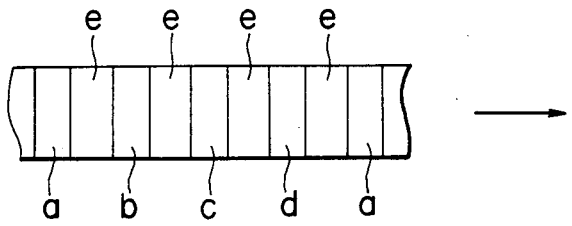
FIG. 1 is a schematic illustration of a thermosensitive image transfer sheet for use in the present invention, in which leuco dye layers a through d and color developer layers e are arranged side by side in the moving direction indicated by the arrow, having a repetition unit of each color developer layer e being interposed between each of the leuco dye layers.

FIG. 1 shows a thermosensitive image transfer sheet for use in the present invention, in which the leuco dye layers a through d and the color developer layer e are arranged side by side in the direction of the arrow, having a repetition unit of the color developer layer e being interposed between each of the leuco dye layers.

Figure 2:
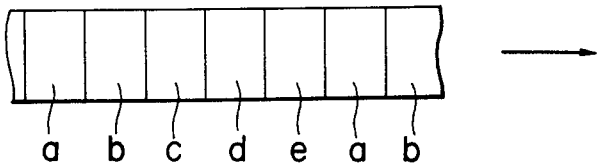

FIG. 2 shows another thermosensitive image transfer sheet, in which the leuco dye layers a through d and the color developer layer e are arranged side by side in the direction of the arrow, having a repetition unit of the color developer layer e being interposed between each leuco dye layer d and each leuco dye layer a.

Figure 3:
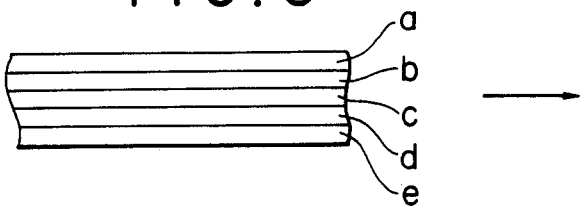
FIG. 3 is a schematic illustration of a further thermosensitive image transfer sheet for use in the present invention, in which leuco dye layers a through d and a color developer layer e are arranged side by side in the direction normal to the moving direction indicated by the arrow.

FIG. 3 shows a further thermosensitive image transfer sheet for use in the present invention, in which the leuco dye layers a through d and the color developer layer e are arranged side by side in the direction normal to the arrow.

Figure 4:
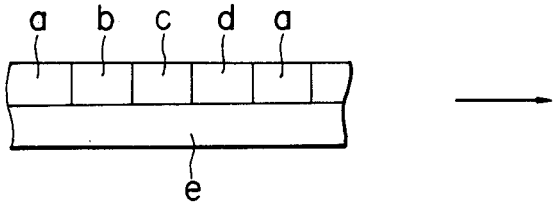
FIG. 4 is a schematic illustration of a still further thermosensitive image transfer sheet for use in the present invention, in which leuco dye layers a through d are arranged side by side in the direction of the arrow and color developer layers e is formed below the alignment of the leuco dye layers a through d, extending in the moving direction indicated by the arrow.

FIG. 4 shows a still further thermosensitive image transfer sheet, in which the leuco dye layers e through d are arranged side by side in the direction of the arrow and the color developer layer e is formed below the alignment of the leuco dye layers a through d, extending in the direction of the arrow.

The above described thermosensitive image transfer sheets can be easily prepared by coating a support material, such as paper, synthetic paper and a plastic film, with dispersions containing one of the leuco dyes and a dispersion of a color developer, for instance, by use of an anastatic printing method or a photogravure printing method.

As the leuco dyes for use in the present invention, any of the leuco dyes that are employed in conventional pressure sensitive recording sheets and thermosensitive recording sheets can be employed.

Preferable examples of such leuco dyes for use in the present invention are triphenylmethane-type leuco dyes, fluoran-type leuco dyes, phenothiazine-type leuco dyes, auramine-type leuco dyes, spiropyran-type leuco dyes and indolynophthalide-type leuco dyes.

Although the leuco dyes for use in the present invention are not limited to these leuco dyes, specific examples of the leuco dyes are as follows:

Yellow Dyes:

3,6-dimethoxyfluoran,
3-cyclohexylamino-6-chlorofluoran, and
3-(p-dimethylaminophenyl)-3-phenylphthalide, Magenta Dyes:

3-diethylamino-7,8-benzfluoran,
3-diethylamino-6-methyl-7-chlorofluoran,
3-di(1-ethyl-2-methylindole)-3-yl-phthalide,
3-diethylamino-6-phenyl-7-aza-fluoran, Cyan Dyes:

3,3-bis(p-dimethylaminophenyl)phthalide,
3,3-bis(p-dimethylaminophenyl)-6-dimethylaminophthalide (or Crystal Violet Lactone),
3,3-bis(p-diethylaminophenyl)-6-dimethylaminophthalide,
2-bis(p-dimethylaminophenyl)methyl-5-dimethylaminobenzoic acid, and
3-(p-dimethylaminophenyl)-3-(p-dibenzylaminophenyl) phthalide, Black Dyes:

3-N-methyl-N-cyclohexylamino-6-methyl-7-anilinofluoran,
3-diethylamino-6-methyl-7-anilinofluoran, and
3-diethylamino-7-piperidinofluoran.

As the color developer for use in the present invention, electron acceptor materials, for instance, phenolic materials, organic acids, salts and esters of organic acids can be employed. For practical use, color developers having a melting point of not higher than 200° C. are preferable.

Specific examples of the coloring agents for use in the present invention are as follows:

| | Melting Point (°C.) |
|---|---|
| 4-tert-butylphenol | 98 |
| 4-hydroxydiphenyl ether | 84 |
| 1-naphthol | 98 |
| 2-naphthol | 121 |
| methyl-4-hydroxybenzoate | 131 |
| 4-hydroxyacetophenone | 109 |
| 2,2'-dihydroxydiphenyl ether | 79 |
| 4-phenylphenol | 166 |
| 4-tert-octylcatechol | 109 |
| 2,2'-dihydroxydiphenyl | 103 |
| 4,4'-methylenebisphenol | 160 |
| 2,2'-methylenebis(4-chlorophenol) | 164 |

-continued

| | Melting Point (°C.) |
|---|---|
| 2,2'-methylenebis(4-methyl-6-tert-butylphenol) | 125 |
| 4,4'-isopropylidenediphenol | 156 |
| 4,4'-isopropylidenebis(2-chlorophenol) | 90 |
| 4,4'-isopropylidenebis(2,6-dibromophenol) | 172 |
| 4,4'-isopropylidenebis(2-tert-butylphenol) | 110 |
| 4,4'-isopropylidenebis(2-methylphenol) | 136 |
| 4,4'-isopropylidenebis(2,6-dimethylphenol) | 168 |
| 4,4'-sec-butylidenediphenol | 119 |
| 4,4'-sec-butylidenebis(2-methylphenol) | 142 |
| 4,4'-cyclohexylidenediphenol | 180 |
| 4,4'-cyclohexylidenebis(2-methylphenol) | 184 |
| salicylic acid | 163 |
| salicylic acid m-tolyl ester | 74 |
| salicylic acid phenacyl ester | 110 |
| 4-hydroxybenzoic acid methyl ester | 131 |
| 4-hydroxybenzoic acid ethyl ester | 116 |
| 4-hydroxybenzoic acid isopropyl ester | 86 |
| 4-hydroxybenzoic acid butyl ester | 71 |
| 4-hydroxybenzoic acid isoamyl ester | 50 |
| 4-hydroxybenzoic acid phenyl ester | 178 |
| 4-hydroxybenzoic acid benzyl ester | 111 |
| 4-hydroxybenzoic acid cyclohexyl ester | 119 |
| 5-hydroxysalicylic acid | 200 |
| 5-chlorosalicylic acid | 172 |
| 3-chlorosalicylic acid | 178 |
| thiosalicylic acid | 164 |
| 2-chloro-5-nitrobenzoic acid | 165 |
| 4-methoxyphenol | 53 |
| 2-hydroxybenzyl alcohol | 87 |
| 2,5-dimethylphenol | 75 |
| benzoic acid | 122 |
| o-toluic acid | 107 |
| m-toluic acid | 111 |
| p-toluic acid | 181 |
| o-chlorobenzoic acid | 142 |
| m-hydroxybenzoic acid | 200 |
| 2,4-dihydroxyacetophenone | 97 |
| resorcinol monobenzoate | 135 |
| 4-hydroxybenzophenone | 133 |
| 2,4-dihydroxybenzophenone | 144 |
| 2-naphthoic acid | 184 |
| 1-hydroxy-2-naphthoic acid | 195 |
| 3,4-dihydroxybenzoic acid ethyl ester | 128 |
| 3,4-dihydroxybenzoic acid phenyl ester | 189 |
| 4-hydroxypropiophenone | 150 |
| salicylosalicylate | 148 |
| phthalic acid monobenzyl ester | 107 |
| 1,1-bis(4'-hydroxyphenyl)ethane | 126 |
| 1,1-bis(4'-hydroxyphenyl)propane | 130 |
| 1,1-bis(4'-hydroxyphenyl)hexane | 111 |
| 1,1-bis(4'-hydroxyphenyl)heptane | 120 |
| 1,1-bis(4'-hydroxyphenyl)-2-propylpentane | 128 |
| 1,1-bis(4'-hydroxyphenyl)-2-ethylhexane | 87 |
| 2,2-bis(4'-hydroxyphenyl)heptane | 101 |
| 3,3-bis(4'-hydroxyphenyl)hexane | 155 |
| 1,1-bis(3'-methyl-4'-hydroxyphenyl)ethane | 101 |
| 1,1-bis(3'-methyl-4'-hydroxyphenyl)propane | 94 |
| 1,1-bis(3'-methyl-4'-hydroxyphenyl)butane | 135 |
| 1,1-bis(3'-methyl-4'-hydroxyphenyl)pentane | 97 |
| 1,1-bis(3'-methyl-4'-hydroxyphenyl)hexane | 78 |
| 1,1-bis(3'-methyl-4'-hydroxyphenyl)heptane | 85 |
| 2-(3'-methyl-4'-hydroxyphenyl)-2-(4'-hydroxyphenyl)propane | 120 |
| 2,2-bis(3'-methyl-4'-hydroxyphenyl)pentane | 128 |
| 2,2-bis(5'-methyl-4'-hydroxyphenyl)hexane | 104 |
| 2,2-bis(3'-methyl-4'-hydroxyphenyl)4-methylpentane | 129 |
| 1,1-bis(3'-methyl-4'-hydroxyphenyl)4-methylbutane | 124 |
| 3,3-bis(3'-methyl-4'-hydroxyphenyl)hexane | 90 |
| 5,5-bis(3'-methyl-4'-hydroxyphenyl)nonane | 128 |
| 2-(4'-hydroxyphenyl)-2-(3'-chloro-4'-hydroxyphenyl)propane | 101 |
| 2,2-bis(3'-isopropyl-4'-hydroxyphenyl)propane | 97 |
| 2,2-bis(3'-tert-butyl-4'-hydroxyphenyl)propane | 117 |
| 2,2-bis(3'-chloro-4'-hydroxyphenyl)propane | 84 |
| 2-(4'-hydroxy-3',5'-dimethylphenyl)-2-(4'-hydroxyphenyl)propane | 127 |
| Bis(3'-methyl-5'-ethyl-4'-hydroxyphenyl)methane | 105 |

-continued

| | Melting Point (°C.) |
|---|---|
| 1,1-(3'-methyl-5'-butyl-4'-hydroxyphenyl)butane | 104 |
| 2,2-bis(4-hydroxyphenyl)octane | 83 |
| Bis(4-hydroxyphenylmercapto)methane | 55 |
| 1,2-bis(4-hydroxyphenylmercapto)ethane | 173 |
| 1,3-bis(4-hydroxyphenylmercapto)propane | 82 |
| 1,4-bis(4-hydroxyphenylmercapto)butane | 181 |
| 1,5-bis(4-hydroxyphenylmercapto)pentane | 98 |
| 1,6-bis(4-hydroxyphenylmercapto)hexane | 166 |
| 1,3-bis(4-hydroxyphenylmercapto)acetone | 74 |
| 1,5-bis(4-hydroxyphenylmercapto)-3-oxapentane | 93 |
| 1,7-bis(4-hydroxyphenylmercapto)-3,5-dioxaheptane | 108 |
| 1,8-bis(4-hydroxyphenylmercapto)-3,5-dioxaoctane | 100 |

In order to increase the density of the transferred images and to obtain transferred images having high and uniform density in repeated use of the image transfer sheet, it is preferable to add to the leuco dye layers and/or the color developer layer a porous filler having an oil absorption of at least 50 ml/100 g (measured in accordance with Japanese Industrial Standards K5101), more preferably 150 ml/100 g or more. It is preferable to add to the leuco dye layers and/or the color developer layer such porous filler in an amount of 0.01 to 1 part by weight, more preferably in an amount of 0.03 to 0.5 parts by weight, to 1 part by weight of the leuco dye or the color developer.

Specific examples of such porous fillers are organic and inorganic finely-divided particles, for examples, of silica, aluminum slicate, alumina, aluminum hydroxide, magnesium hydroxide, urea-formaldehyde resin and styrene resin.

When the leuco dyes and the color developer are coated on the support sheet, it is preferable that the amount of each leuco dye and the color developer be in the range of 0.1 to 20 g/m$^2$ (when dried), more preferably in the range of 0.3 to 10 g/m$^2$ (when dried).

As the binders for binding the leuco dyes and the color developer to the support sheet, thermoplastic resins and thermosetting resins can be employed and it is preferable that those resins have a melting or softening point in the range of 50° C. to 130° C. More specifically, with respect to resins having melting points, it is preferable that the melting points be not higher than 130° C. from the viewpoint of the thermal resistance and thermal sensitivity of the image transfer sheet. With respect to resins having softening points, the softening point of not higher than 130° C. is sufficient for practical use in view of the required thermosensitivity of the thermosensitive image transfer sheet.

Specific examples of such resins for use in the present invention are as follows:

polystyrene, polypropylene, petroleum resin, acrylic resin, vinyl chloride resin, vinyl acetate resin, vinylidene chloride resin, polyvinyl alcohol, cellulose resin, polyester, fluorine-contained resin, silicone resin, natural rubber, rubber chloride, butadiene rubber, olefinic rubber, phenolic resin, urea resin, meramine resin, epoxy resin, polyimide and polyamide.

The above resins can be used alone, in the form of copolymers and in the form of mixtures. It is preferable that such resins be used in an amount of 0.01 to 1 part by weight to one part of the leuco dye or the color developer. When the amount of the resins is less than 0.01 part by weight, the binding force of the resins becomes so weak that the leuco dye and the color developer cannot be properly bound to the support sheet. On the other hand, when the amount of the resins exceeds 1 part by weight, the thermosensitivity of the thermosensitive image transfer sheet so decreases that the image density of the obtained transferred images becomes insufficient for practical use. Therefore, it is most preferable that the resins be used in an amount of 0.05 to 0.5 parts by weight to 1 part of the leuco dye or the color developer in order to obtain images with high and uniform density in multiple image transfer.

In order to obtain multi-colored images by use of the thermosensitive image transfer sheet in the present invention, the image transfer sheet is superimposed on a receiving sheet in such a manner that the image transfer layer side (including the leuco dye layers and the color developer layer) comes into contact with the receiving sheet, and thermal printing is performed on the back side of the thermosensitive image transfer sheet by use of a heat application means, such as a thermal printer, in accordance with the color tone information applied thereto, whereby the leuco dyes and the color developer are transferred to the receiving sheet and are caused to react thereon to form colored images.

In this case, as the receiving sheet, a sheet of plain paper or synthetic paper and a plastic film can be employed.

When the leuco dyes and the color developer are transferred to the receiving sheet to cause the two to react, it is preferable that the transferred amount of the color developer be in the range of 1 to 10 parts by weight, more preferably in the range of 2 to 5 parts by weight, to one part of the transferred leuco dye.

In the present invention, when the total transferred amount of the leuco dye and the color developer to the support sheet is about 1 g/$^2$, images having sufficiently high image density for practical use can be obtained.

As mentioned above, heat application to the thermosensitive image transfer sheet is performed in accordance with the color tone information. More specifically, when the desired images to be recorded contain the colors of yellow, magenta, cyan and black, the respective leuco dye layers and the color developer layer are heated, so that the leuco dyes and the color developer are transferred to the receiving sheet to cause the coloring reactions thereon. In this case, the order of heat application to the leuco dye layers and the color developer layer can be determined as desired. For instance, the heat application to the leuco dye layers can be followed by the heat application to the color developer layer, and vice versa.

For obtaining a red recorded image, for instance, the yellow leuco dye layer, the magenta leuco dye layer and the color developer layer are heated and superimposed on the receiving sheet. When a green recorded image is obtained, the yellow leuco dye layer, the cyan leuco dye layer and the color developer layer are heated and superimposed on the receiving sheet. When a blue recorded image is obtained, the cyan leuco dye layer, the magenta leuco dye layer and the color developer layer are heated and superimposed on the receiving sheet. As mentioned above, when the red, green and blue recorded images are obtained, the order of heat application to the leuco dye layers and the color developer layer can be set as desired. For instance, the heat application to the two leuco dye layers can be followed by the heat application to the color developer layer, and vice versa.

By referring to the following examples, the present invention will now be explained in more detail.

EXAMPLE 1

For the formation of the leuco dye layers of a thermosensitive recording sheet, the following leuco dyes were employed:

(1) Yellow Dye . . . 3-cyclohexylamino-6-chlorofluoran
(2) Magenta Dye . . . 3-diethylamino-6-methyl-7-chlorofluoran
(3) Cyan Dye . . . 3,3-bis(p-diethylaminophenyl)-6-dimethylaminophthalide
(4) Black Dye . . . 3-N-methyl-N-cyclohexylamino-6-methyl-7-anilinofluoran A mixture of the following components was dispersed in a ball mill for 24 hours, whereby a yellow leuco dye dispersion A-1, a magenta leuco dye dispersion B-1, a cyan leuco dye dispersion C-1 and a black dye dispersion D-1 were prepared.

| | |
|---|---|
| Each leuco dye | 10 g |
| Styrene resin (Piccolastic D-100, m.p. 100° C., made by Esso Standard Sekiyu K.K.) | 2 g |
| Methyl ethyl ketone | 100 g |

A mixture of the following components was dispersed in a ball mill for 24 hours, whereby a color developer dispersion E-1 was prepared.

| | |
|---|---|
| 4-hydroxybenzoic acid n-butyl ester | 20 g |
| Styrene resin | 5 g |
| Methyl ethyl ketone | 100 g |

Each of the thus prepared dispersions A-1, B-1, C-1, D-1 and E-1 was coated on a sheet of paper by a photogravure printing method, whereby a thermosensitive image transfer sheet No. 1 as shown in FIG. 1 was prepared. In the figure, reference symbol a indicates a yellow leuco dye layer; reference symbol b, a magenta leuco dye layer; reference symbol c, a cyan leuco dye layer; reference d, a black leuco dye layer; and reference e, a color developer layer. The deposition of each of the leuco dye layers a through d being 1 g/m$^2$ when dried, and the deposition of the color developer layer e was 2 g/m$^2$ when dried.

The thus prepared thermosensitive image transfer sheet No. 1 was superimposed on a sheet of plain paper and 1 mJ of thermal energy was successively applied by a thermal head to the back side of the thermosensitive image transfer sheet, whereby yellow, magenta, cyan and black images were obtained on the sheet of plain paper.

More specifically, the yellow leuco dye layer a was transferred to the plain paper under application of heat, whereby a yellow leuco dye transferred portion a-1 was formed on the plain paper. By moving the thermosensitive image transfer sheet in the direction of the arrow, the color developer layer e was superimposed on the yellow leuco dye transferred portion a-1 and heat was applied thereto, whereby the color developer was transferred to the portion a-1 and a yellow recorded image was obtained. Likewise, by heating the leuco dye layers b, c and d and the color developer layer e in combination, magenta, cyan and black images were obtained.

The image densities of the thus obtained images were 0.75 (yellow), 1.31 (magenta), 1.15 (cyan) and 1.25 (black).

EXAMPLE 2

For the formation of the leuco dye layers of another thermosensitive recording sheet, the following leuco dyes were employed:

(1) Yellow Dye . . . 3-(p-dimethylaminophenyl)-3-(phenyl) phthalide
(2) Magenta Dye . . . 3-diethylamino-7,8-benzfluoran
(3) Cyan Dye . . . 3,3-bis(p-dimethylaminophenyl)phthalide
(4) Black Dye . . . 3-diethylamino-6-methyl-7-anilinofluoran A mixture of the following components was dispersed in a ball mill for 24 hours, whereby a yellow leuco dye dispersion A-2, a magenta leuco dye dispersion B-2, a cyan leuco dye dispersion C-2 and a black dye dispersion D-2 were prepared.

| | |
|---|---|
| Each leuco dye | 10 g |
| Polyester resin | 3 g |
| Finely-divided silica powder (with an oil adsorption of 300 ml/100 g) | 3 g |
| Methyl ethyl ketone | 100 g |

A mixture of the following components was dispersed in a ball mill for 24 hours, whereby a color developer dispersion E-2 was prepared.

| | |
|---|---|
| 1,1-bis(4'-hydroxyphenyl)-2-ethylhexane | 20 g |
| Vinyl chloride - vinyl acetate copolymer | 10 g |
| Finely-divided silica powder (with an oil adsorption of 300 ml/100 g) | 5 g |
| Methyl ethyl ketone | 100 g |

Each of the thus prepared dispersions A-2, B-2 C-2, D-2 and E-2 was coated on a sheet of paper by a photogravure printing method, whereby a thermosensitive image transfer sheet No. 2 as shown in FIG. 2 was prepared, with the deposition of each of the leuco dye layers a through d being 3 g/m$^2$ when dried, and the deposition of the color developer layer e being 6 g/m$^2$ when dried.

The thus prepared thermosensitive image transfer sheet No. 2 was superimposed on a sheet of plain paper and 1 mJ of thermal energy was successively applied by a thermal head to the back side of the thermosensitive image transfer sheet, whereby clear yellow, magenta, cyan, red, green, blue and black images were obtained on the sheet of plain paper.

More specifically, the leuco dye layers a (yellow), b (magenta), c (cyan) and d (black) were heated, so that the respective leuco dyes in those dye layers were transferred to a first portion of a sheet of plain paper, whereby leuco dye transferred portions a-1 (yellow), b-1 (magenta), c-1 (cyan) and d-1 (black) were formed on the first portion of the plain paper.

Then the thermosensitive image transfer sheet was moved onto a second portion of the plain paper and leuco dye transferred portions a-2 (yellow), b-2 (magenta), c-2(cyan) and d-2 (black) were formed on the second portion of the plain paper in the same manner as mentioned above.

The thermosensitive image transfer sheet was further moved in such a manner that the leuco dye layers b (magenta), c (cyan) and a (yellow) were respectively superimposed on the leuco dye transferred portions a-2 (yellow), b-2 (magenta) and c-2 (cyan), followed by application of heat thereto for transferring thereto the respective leuco dyes from the respective leuco dye layers, whereby leuco dye transferred portions b·a-2, c·b-2, and a·c-2 were formed. The color developer layer e was then superimposed to the leuco dye transferred portion a-1, b-1, c-1, d-1, b·a-2, c·b-2, a·c-2, and heat was applied thereto, whereby clear yellow, magenta, cyan, black, red, blue and green images were formed on the plain paper.

The above described multi-colored image recording operation was repeated five times by use of the same thermosensitive image transfer recording sheet. The result was that the image densities of the recorded images scarcely changed during the five recording operations as shown below:

| Color | First Recording | Fifth Recording |
|---|---|---|
| Yellow | 0.71 | 0.70 |
| Magenta | 1.27 | 1.25 |
| Cyan | 1.13 | 1.11 |
| Red | 1.10 | 1.15 |
| Green | 1.09 | 1.08 |
| Blue | 1.22 | 1.22 |
| Black | 1.25 | 1.24 |

What is claimed is:

1. A method for recording a multicolored image, comprising the steps of:

superimposing on a receiving sheet a thermosensitive image transfer sheet including four leuco dye layers respectively containing yellow, magenta, cyan and black leuco dyes that can be respectively colored in yellow, magental, cyan and black, and a color developer layer containing a color developer capable of inducing the said respective color formation in the said leuco dyes when the said color developer reacts with the said leuco dyes under application of heat thereto, wherein the said leuco dyes layers and the said color developer layer are separately positioned side-by-side on the said thermosensitive image transfer sheet;

applying heat selectively to the portions of the said thermosensitive image transfer sheet corresponding to the said leuco dyes layers and the said color developer layer in accordance with desired color tone information; and (1) transferring the said leuco dyes from the said selectively heated leuco dyes layers to the said receiving sheet in a side-by-side or overlapping way in accordance with the desired color tone information, followed by transferring the said color developer onto the said transferred leuco dyes on said receiving sheet; or (2) transferring the said color developer to the said receiving sheet, followed by transferring the said leuco dyes from the said selectively heated leuco dye onto the said transferred color developer layers in a side-by-side or overlapping way in accordance with the desired color tone information.

2. The method for recording a multi-colored image of claim 1, wherein the transferred amount of the said color developer is in the range of from 1 to 10 parts by weight to one part by weight of the said transferred leuco dye.

3. A thermosensitive image transfer sheet comprising a support sheet and an image transfer layer formed thereon, the said image transfer layer comprising a binder resin and four leuco dye layers respectively containing yellow, magenta, cyan and black leuco dyes that can be respectively colored in yellow, magenta, cyan and black, and a color developer layer containing a color developer capable of inducing the said respective color formation in the said leuco dyes when said color developer reacts with the said leuco dyes under application of heat thereto, wherein the said leuco dyes and the said color developer are positioned side-by-side.

4. The thermosensitive image transfer sheet of claim 3, wherein the said four leuco dye layers and the said color developer layer on the said thermosensitive image transfer sheet constitute a repetition unit of the said four leuco dye layers being arranged side-by-side in the moving direction of the said thermosensitive image transfer sheet, with the said color developer layer being interposed between each of said leuco dye layers.

5. The thermosensitive image transfer sheet of claim 3, wherein the said four leuco dye layers and the said color developer layer on the said thermosensitive image transfer sheet constitute a repetition unit of the said four leuco dyes being arranged side-by-side in the moving direction of the said thermosensitive image transfer sheet, with the said color developer layer being interposed between the first and the fourth of said leuco dye layers.

6. The thermosensitive image transfer sheet of claim 3, wherein each of the said four leuco dye layers and the said color developer layer on the said thermosensitive image transfer sheet extend in the moving direction of the said thermosensitive image transfer sheet, with each layer arranged side-by-side in the direction normal to the moving direction of the said thermosensitive image transfer sheet.

7. The thermosensitive image transfer sheet of claim 3, wherein the said four leuco dye layers on the said thermosensitive image transfer sheet constitute a repetition unit of the said four leuco dye layers being arranged side-by-side in the moving direction of the said thermosensitive image transfer sheet, with the said color developer layer disposed along the said repetition unit of the said leuco dye layers, extending in the moving direction of the said thermosensitive image transfer sheet.

8. The thermosensitive image transfer sheet of claim 3, wherein the said image transfer layer further comprises a porous filler having an oil absorption of at least 50 ml/100 g measured in accordance with Japanese Industrial Standards K5101.

9. The thermosensitive image transfer sheet of claim 8, wherein the amount of the said porous filler in each layer is in the range of from 0.01 to 1 part by weight to 1 part by weight of the said leuco dye or 1 part by weight of the said color developer.

10. The thermosensitive image transfer sheet of claim 3, wherein the amount of the said leuco dye in each leuco dye layer and the amount of the said color developer in the said color developer are each respectively in the range of from 0.1 $g/m^2$ to 20 $g/m^2$.

11. The thermosensitive image transfer sheet of claim 3, wherein the melting point or softening point of the said binder resin is in the range of from 50° C. to 130° C.

12. The thermosensitive image transfer sheet of claim 3, wherein the amount of the said binder resin in each layer is in the range of from 0.01 to 1 part by weight to one part by weight of the said leuco dye or to one part by weight of the said color developer.

13. The thermosensitive image transfer sheet of claim 3, wherein the said yellow leuco dye is selected from the group consisting of 3,6-dimethoxyfluoran, 3-cyclohexylamino-6-chlorofluoran, and 3-(p-dimethylaminophenyl)-3-phenylphthalide.

14. The thermosensitive image transfer sheet of claim 3, wherein the said magenta dye is selected from the group consisting of 3-diethylamino-7,8-benzfluoran, 3-diethylamino-6-methyl-7-chlorofluoran, 3-di(1-ethyl-2-methylindole)-3-yl-phthalide and 3-diethylamino-6-phenyl-7-aza-fluoran.

15. The thermosensitive image transfer sheet of claim 3, wherein the said cyan dye is selected from the group consisting of 3,3-bis(p-dimethylaminophenyl)phthalide, 3,3-bis(p-dimethylaminophenyl)-6-dimethylaminophthalide (or Crystal Violet Lactone), 3,3-bis(p-diethylaminophenyl)-6-dimethylamino-phthalide, 2-bis(p-dimethylaminophenyl)methyl-5-dimethylamino-benzoic acid and 3-(p-dimethylaminophenyl)-3-(p-dibenzylaminophenyl)phthalide.

16. The thermosensitive image transfer sheet of claim 3, wherein the said black dye is selected from the group consisting of 3-N-methyl-N-cyclohexylamino-6-methyl-7-anilinofluoran, 3-dithylamino-6-methyl-7-anilinofluoran, and 3-diethylamino-7-piperidinofluoran.

* * * * *